United States Patent [19]

Harper

[11] Patent Number: 4,882,557

[45] Date of Patent: Nov. 21, 1989

[54] MULTIPOLE CIRCUIT BREAKER SYSTEM WITH DIFFERENTIAL POLE OPERATION

[75] Inventor: George S. Harper, Cambridge, Md.

[73] Assignee: Airpax Corporation, Cambridge, Md.

[21] Appl. No.: 120,479

[22] Filed: Nov. 13, 1987

[51] Int. Cl.[4] ..... H01H 75/00

[52] U.S. Cl. ..... 335/9; 335/10

[58] Field of Search ..... 335/6–10, 335/172, 174

[56] References Cited

U.S. PATENT DOCUMENTS

| | | | |
|---|---|---|---|
| 489,553 | 1/1983 | Baehr . | |
| 568,450 | 9/1896 | Meek . | |
| 3,242,286 | 3/1966 | Heilman et al. . | |
| 3,427,419 | 2/1969 | Findley, Jr. . | |
| 3,444,488 | 5/1969 | Harper . | |
| 3,492,610 | 1/1970 | Strobel . | |
| 3,497,838 | 2/1970 | Merriken et al. . | |
| 3,786,380 | 1/1974 | Harper . | |
| 3,949,336 | 4/1976 | Dietz . | |
| 4,002,870 | 1/1977 | Phillips . | |
| 4,056,797 | 11/1977 | Rys . | |
| 4,062,052 | 12/1977 | Harper et al. . | |
| 4,079,346 | 3/1978 | Rys . | |
| 4,222,019 | 9/1980 | Rusch . | |
| 4,295,025 | 10/1981 | Beatty, Jr. et al. . | |
| 4,383,146 | 5/1983 | Bur | 335/8 |
| 4,409,573 | 10/1983 | Di Marco et al. . | |
| 4,471,183 | 9/1984 | Bauer et al. . | |
| 4,574,170 | 3/1986 | Abe et al. | 335/8 |
| 4,584,621 | 4/1986 | Yang . | |

*Primary Examiner*—H. Broome
*Assistant Examiner*—Lincoln Donovan
*Attorney, Agent, or Firm*—Saidman, Sterne, Kessler & Goldstein

[57] ABSTRACT

A multiple circuit breaker system wherein each single pole breaker within the multiple breaker system have very similar structure and dimensions, except that at least one of the breakers (e.g. the one which is connected to a floating neutral pole) has an additional articulation which the other breakers do not have. This additional articulation, and the associated spring action, provide extended contact time.

14 Claims, 10 Drawing Sheets

MULTIPOLE CIRCUIT BREAKER SYSTEM WITH DIFFERENTIAL POLE OPERATION

BACKGROUND OF THE INVENTION

1. Field of the Invention

The present invention relates to circuit breaker systems, and specifically to multipole circuit breaker systems for multiphase circuits which utilize sequential contact operation for improved safety.

2. Discussion of the Related Art

Many formats for electrical current delivery are currently in use. For example, a common end-user standard in the United States uses two electrical conductors. This system (commonly known as a single-phase system) may utilize a single neutral conductor in conjunction with a single electrified or "hot" conductor. The neutral conductor remains essentially at an earth ground voltage, and the hot conductor commonly provides a sinusoidal time varying voltage (e.g. 120 Volts at a frequency of 60 Hz).

Another format of electrical current delivery is commonly known as a three-phase system. This format includes three electrified or "hot" conductors, and a fourth (neutral) conductor. Each hot conductor generally provides an identical sinusoidal waveform, but the voltage supplied by each conductor is phase-shifted ±120° from the two remaining hot conductors. This standard is very widely used, especially in industrial applications.

In three-phase systems in the United States, this neutral conductor is caused to remain substantially at an earth-ground voltage potential. (In some instances a low voltage may occur between the neutral conductor and the local earth-ground potential in the neighborhood of the load, but this does not normally pose a safety threat.)

In contrast, some three-phase power supply systems in some other countries (notably France) provide a fourth neutral conductor which is not caused to remain substantially at an earth-ground voltage potential. This fourth conductor may be referred to as a "floating neutral." The voltage between the neutral conductor and an earth-ground potential may pose a serious safety threat should a person come into contact with conductors at the potential of the neutral conductor.

Therefore, in countries using such systems, it is a common practice to cause the floating neutral to be disconnected when the power is removed from the electrical load. (In the U.S., where the neutral pole is substantially at an earth ground voltage potential, this is not allowed by the national electrical code requirements.)

An important element in many electrical protection and safety systems is a circuit breaker device. A circuit breaker device is designed to open the electrical circuit in the event of an unacceptably high current flow. It is important to realize that a circuit breaker device can only offer protection from dangerous current levels, not dangerous voltage levels. Although many dangerous situations may involve both high voltage and high current levels, this need not be the case. In the case of an electrical equipment fault, the circuit breaker device offers no protection unless a low resistance electrical path is present to allow the excessive current to return from the electrical fault. For example, a circuit breaker device will offer no protection if an electrical fault occurs to an ungrounded chassis (which provides no electrical return path). Therefore, it is generally desirable in an electrical environment to cause conductive structures, such as chassis or enclosures, to remain at or near an earth ground voltage potential.

In the three-phase systems in which the neutral conductor is "floating" (not substantially at an earth ground voltage potential), it is desirable to place a circuit breaker device in the neutral conducting path. This has two functions. One function is to protect against unacceptably high current levels on the floating neutral conductor. Unacceptably high current may occur when the floating neutral pole experiences a fault condition to an earth ground potential. Another function is to prevent exposure to the possible high voltages on the neutral conducting path, after a circuit breaker has tripped on one of the other poles.

Multipole circuit breakers typically comprise several interconnected single-pole units positioned adjacent each other. (An individual circuit breaker must be provided for each electrified or "hot" conductor, as an overcurrent condition may occur on any of the individual phases.) The manual switching handles of the respective breakers may be connected to each other for simultaneous manual actuation of all poles. Alternatively, or in addition to connecting the respective manual switching handles, a mechanism may be provided to trip open all of the breaker poles simultaneously, whenever any one of them is tripped.

Mechanical tolerances in the various linkages used to join the multiple poles may mean that the several breakers make or break contact in a sequential fashion. This inadvertent sequential contact operation is undesirable, especially in a floating neutral system.

Since the floating neutral system requires a circuit breaker device in the neutral leg, a problem may be created if a hot pole is closed prior to the neutral pole, or if the neutral pole is opened prior to any nonneutral pole. The voltage applied by one or more hot poles prior to the connection of the neutral pole can be dangerous, since, as previously mentioned, the neutral pole will oftentimes provide an electrical return path in the event of an electrical fault. Therefore, personnel may be briefly exposed to dangerous voltages because the circuit breaker device cannot operate until the return path (i.e., the neutral pole) is closed.

Even if a multipole circuit breaker system can achieve substantially simultaneous contact operation of its several poles, it can be seen that in the interest of safety, it would be beneficial to have a floating neutral multipole circuit breaker system which assures that the neutral pole breaker will make contact prior to and break contact subsequent to the remaining single pole breakers. A system such as this will thereby eliminate any of the previously mentioned problems.

An example of a circuit protective device can be seen in U.S. Pat. No. 3,949,336, to Dietz. The device disclosed in the Dietz patent protects against a ground fault condition using sequential contact operation. The neutral contact is made first and broken last to prevent the hot contacts from being connected without the neutral contact.

The present invention is directed, in part, to overcoming the above-mentioned problems associated with known circuit breaker devices.

SUMMARY OF THE INVENTION

In one of its aspects, the present invention includes a multipole circuit breaker system which comprises two types of single pole breaker assemblies. Preferably the floating neutral pole (in a multi-phase system with floating neutrals) is connected through a breaker assembly which makes sooner and breaks later than the breaker assemblies connected to the hot poles. That is, any neutral breaker of the system will close before any non-neutral breaker during a manual closing operation, and any neutral breaker will break contact after every non-neutral breaker during an opening operation (whether caused manually or by a trip condition).

This sequential contact operation is achieved by using a breaker mechanism for the neutral pole which is generally analogous to the breaker mechanisms for the other poles, but also includes an additional articulation which the other, non-neutral poles do not have.

It should be understood that a general objective in the circuit breaker art is to open the electrical contacts as rapidly as possible upon the sensing of a trip condition. However, the additional articulation taught by the present invention (which is preferably used in the neutral pole breaker but not in the nonneutral or hot pole breakers) acts to delay the breaking of electrical contact upon the sensing of a trip condition. Thus, this innovative teaching is contrary to the general understanding of those skilled in the art. This delay has not been found to degrade performance of a circuit breaker system in accordance with the present invention.

Normally the average current levels on the hot poles will be higher than the average current level on the neutral pole. This means that, to some extent, a slower contact break operation on the neutral pole can be tolerated if the required sequential breaking is achieved.

It should be noted that the present invention provides not merely a circuit breaker, with all of the advantages described; the present invention provides a circuit breaker which can also be operated manually as a switch with reliable sequential pole operation.

Of course, the present invention may be utilized in any instance where sequential contact operation of a multipole circuit breaker system may be desirable, and is not only applicable to the problems of floating neutral multi-phase systems.

Another innovative principle which may be derived from the teachings herein is: in a multi-pole breaker system, sequential contact operation can be achieved by using a set of breakers which are all almost identical, except that one of the breakers (e.g. the breaker on the floating neutral pole) has, added to the articulations of the other breakers, an additional movement, such that overtravel upon closing of the contacts occurs in that additional movement, and such that the effective spring constant (at the contacts) due to the additional movement is smaller, at the point of travel where the contacts first come together, than the effective spring constant (at the contacts) in the other breakers at the point of travel where the contacts first come together.

The various elements which comprise the neutral and non-neutral breakers of the presently preferred embodiment differ in some significant respects, but are the same in many other respects. The use of many similar components facilitates the interchangeability of the various component parts, and thus furthers the efficiency of manufacture.

The sequential contact operation provided by the present invention is advantageous in areas using multiphase power supplies with a neutral pole which is "floating" (not substantially at earth ground voltage potential).

The above-described features and advantages are best understood in view of the subsequent description of the preferred embodiments of the present invention, and in view of the accompanying drawings.

BRIEF DESCRIPTION OF THE DRAWINGS

FIGS. 1–6*b* show the two types of breakers preferably used in a multipole circuit breaker system according to the present invention. FIGS. 1, 2, 5*b*, and 6*b* show the type of breaker preferably used for the hot poles, and FIGS. 3, 4, 5*a*, and 6*a* show the type of breaker preferably used for the neutral pole.

FIG. 1 is a side view of a hot-pole breaker mechanism in a breaker case with one side removed to show the mechanism.

FIG. 2 shows portions of the hot-pole mechanism in the "OFF" position.

FIG. 3 shows portions of a neutral-pole breaker mechanism in the "ON" position.

FIG. 4 shows portions of a neutral-pole breaker mechanism in the "OFF" position.

FIG. 5*a* shows the assembly of FIG. 4 at an instant during manual closure of the breaker when the contacts have just closed.

FIG. 5*b* shows the assembly of FIG. 2 at the same stage of handle movement as shown in FIG. 5*a*.

FIG. 6*a* shows the assembly of FIG. 4 at an instant (during collapse of the cam link and housing link as caused by a trip condition) when the contacts are still closed.

FIG. 6*b* shows the assembly of FIG. 2 at an instant comparable to that of FIG. 6*a*, showing that the contacts have already opened.

Figure 1:
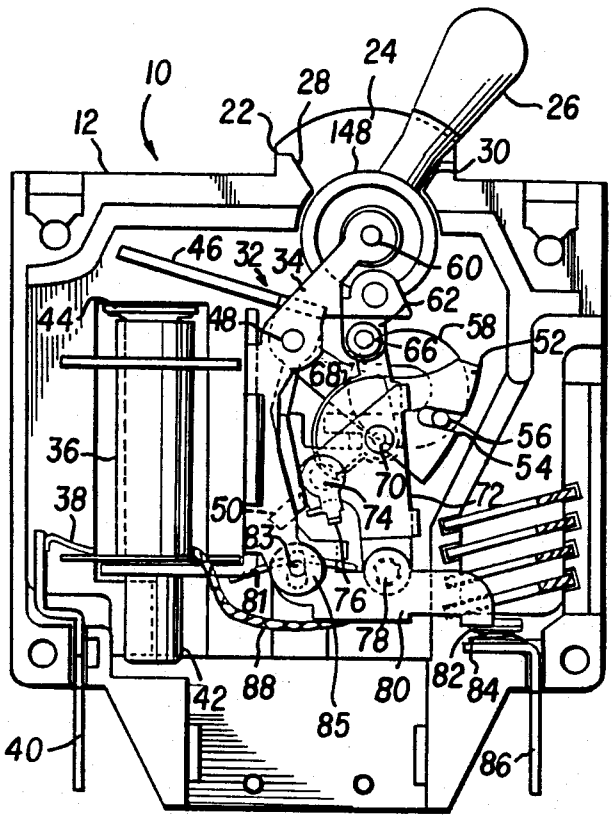

Applicant notes that FIG. 1, and several other figures, are common to U.S. patent application Ser. No. 486,716.

DESCRIPTION OF THE PREFERRED EMBODIMENTS

A multipole circuit breaker system according to the present invention preferably includes single pole breaker assemblies of two different types. Preferably the single pole breakers will be mechanically linked (using conventional methods) so that closing or opening of any one single pole breaker assembly (whether manual or due to an overcurrent condition) will cause all of the single pole breakers to open or close correspondingly. An innovative structure is used in the second type breaker (i.e. the neutral pole breaker) to achieve sequential operation, so that the neutral pole breaker always opens last and closes first. The type of breaker assembly preferably used for the hot poles will be described first, and then the type of breaker assembly used for the neutral poles (in the same circuit breaker system) will be described. So of the advantages of this class of embodiments derive from the structural similarities between the first type and second type breakers, and this sequence of exposition will help to show this.

Referring to FIG. 1, an example of a single pole circuit breaker which may be utilized for hot poles in a multipole breaker system according to the present invention is designated generally by reference numeral 10. The circuit breaker includes a case 12 formed of electrically insulating material, such as plastic.

A boss 22 extends from the upper portion of case 12 and includes an opening 24 for a toggle handle 26. Handle 26 is also formed from a non-conductive material, typically molded plastic. A pair of surfaces 28 and 30 define opposite ends of opening 24 through which handle 26 passes.

The trip mechanism which may be utilized in the single pole circuit breakers of the present invention is designated generally by reference numeral 32. In this sample embodiment, it includes a one-piece frame 34 which is fixedly mounted within case 12. Frame 34 supports an overcurrent trip coil 36, which is connected through an electrical lead 38 to a terminal 40.

Coil 36 surrounds a magnetic core 42. Preferably (but not necessarily) core 42 includes a delay tube. By way of example only, the coil and delay tube assembly may be of the type shown and described in commonly assigned U.S. Pat. No. 4,062,052 to Harper et al., which is hereby incorporated by reference.

Magnetic core 42 terminates in a pole piece 44. Adjacent pole piece 44 is an armature 46 pivotally mounted on a pin 48 secured to frame 34. Armature 46 is rotatably biased in a clockwise direction (relative to the representation in FIG. 1) by a spring (not shown), and comprises a leg 50 and a counterweight 52. Counterweight 52 comprises an enlarged extension of armature 46, and may include a slot 54 for receiving a pin 56 of an inertia wheel 58 rotatably mounted on frame 34. The function of the inertia wheel is set forth in detail in commonly assigned U.S. Pat. No. 3,497,838 to Merriken et al., which is hereby incorporated by reference.

Handle 26 is pivotally mounted on a pin 60 secured in frame 34. Handle 26 includes an ear 62 with aperture for receiving a rivet or pin 66 which connects handle 26 to a cam link 68. Cam link 68 is pivotally connected by a rivet or pin 70 to a housing link 72. A sear pin 74, as is well known in the art, is rotatably mounted in housing link 72 and is biased in a clockwise direction (relative to the representation in FIG. 1) by spring means (not shown). A sear striker bar 76 is secured to sear pin 74.

A joint 78 (e.g. a pivot joint secured by a rivet or pin) pivotally attaches housing link 72 to a movable contact arm 80. Arm 80 includes a slot 85, which is pivotally mounted on a pin 83 secured to frame 34. The arm 80 is biased in a counterclockwise direction (relative to the representation in FIG. 1) by a spring 81. Contact arm 80 carries on the end thereof a movable contact 82 which is held, when the breaker is in the closed, or ON position, against a stationary contact 84 mounted on terminal 86. Thus the single pole circuit breaker makes an interruptible electrical connection between terminals 40 and 86, as is well known.

Coil 36 is electrically connected to contact arm 80 by a conductive braid 88. When the breaker is closed, a continuous electrical path is created through terminal 40, lead 38, coil 36, braid 88, contact arm 80, contacts 82 and 84, and terminal 86.

In the operation of a single pole breaker of this type, when the current exceeds a predetermined threshold, the force due to the magnetic field generated by coil 36 will be sufficient to move armature 46 toward pole piece 44. As armature 46 pivots about pin 48, leg 50 contacts sear striker bar 76, rotating sear pin 74 in a counterclockwise direction (relative to the representation in FIG. 1). Rotation of sear pin 74 disengages the pin from a seat (not shown) of cam link 68. In the absence at the restraint imposed by sear pin 74, the toggle mechanism comprising links 68 and 72 is free to collapse.

Figure 2:
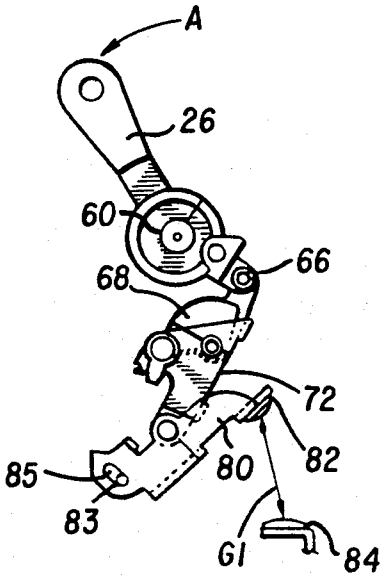

The circuit may also be interrupted manually. FIG. 2 illustrates portions of the sample embodiment of FIG. 1 in the manually open condition. To open the circuit manually, handle 26 is rotated in a counterclockwise direction (relative to the representation in FIG. 2) about the pivot axis at pin 60, as indicated by the arrow A in FIG. 2. Rivet 66 (securing cam link 68 to handle 26) accordingly orbits or rotates about pin 60 in a counterclockwise direction (relative to the representation in FIG. 2). Sear pin 74 remains engaged, and links 68 and 72 remain locked in place, as shown in FIG. 1. As rivet 66 traverses an arc centered on the axis of pin 60, links 68 and 72 are raised and rotated, as illustrated in FIG. 2. Joint 78 moves upwardly and traverses an arc centered on the axis of pin 83. This upward movement results in the separating of the contacts (82, 84) by a gap G1, so that the circuit path between terminals 40 and 86 is interrupted.

Multipole circuit breakers may include several single pole circuit breakers, of the type just described or of other types. As exemplified by U.S. Pat. Nos. 3,444,488 and 3,786,380, multipole circuit breakers may comprise a plurality of single pole circuit breakers adjacent each other and operatively connected, e.g. so that manual opening or closing of one causes all to move similarly, and so that overcurrent tripping of one breaker causes all to trip. A wide variety of methods for interconnection of single pole breakers are known in the art and may optionally be utilized.

The present invention accomplishes sequential contact operation in a multipole breaker system by utilizing two somewhat different types of single pole breaker assemblies in a multipole arrangement. These two individual single pole breakers may be referred to as a neutral breaker and a non-neutral breaker.

Figure 3:
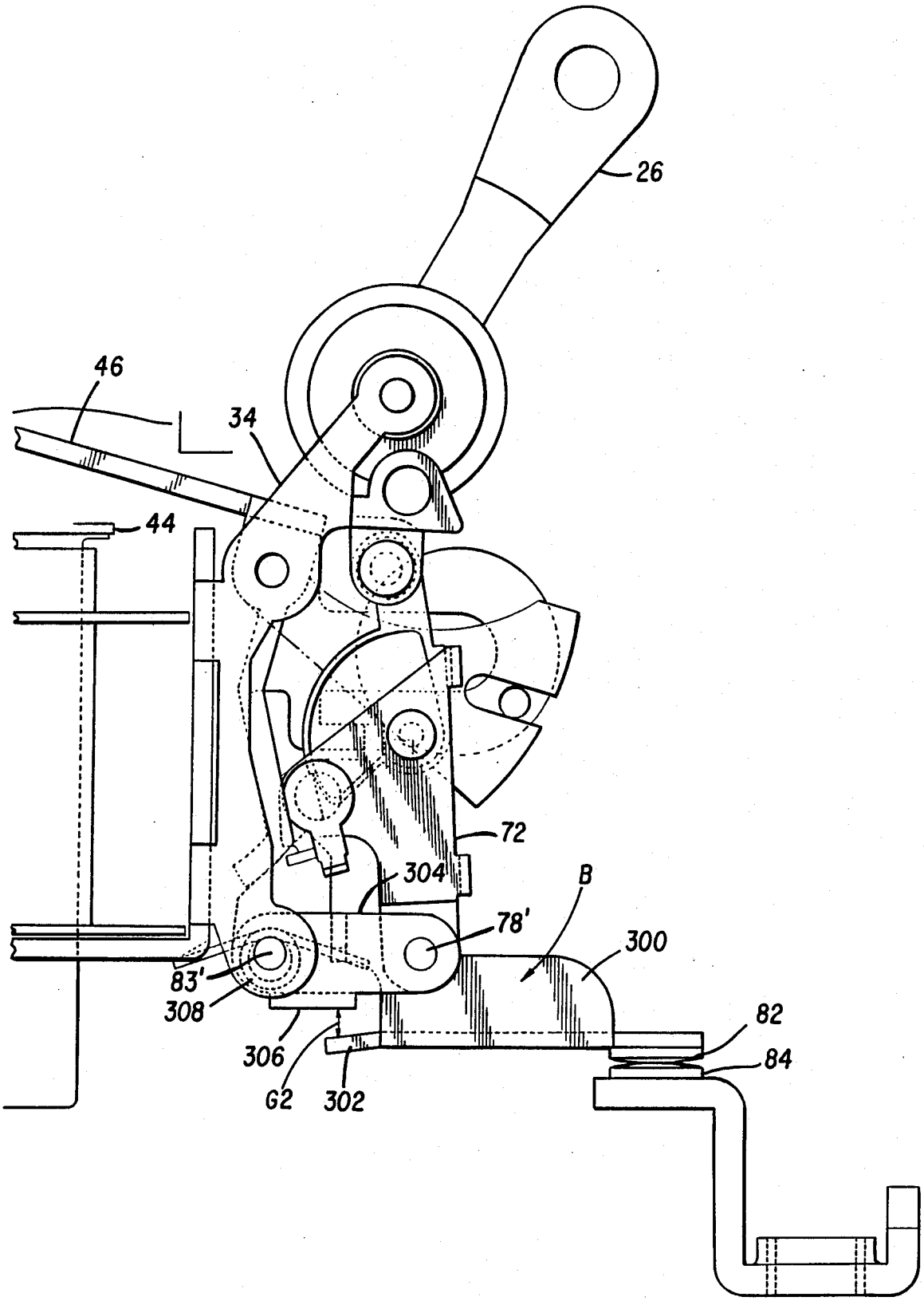

FIG. 3 shows a sample embodiment of a second type breaker, which can be used in combination with breakers like that shown in FIG. 1 (or in combination with other types of breakers) to achieve sequential contact operation.

Figure 8A:
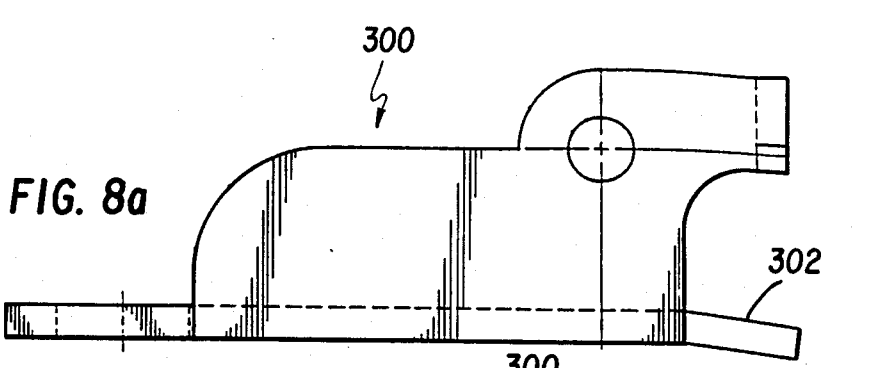
FIG. 8*a* is a is a side view of the contact bar in accordance with a preferred embodiment of the present invention.
Figure 8B:
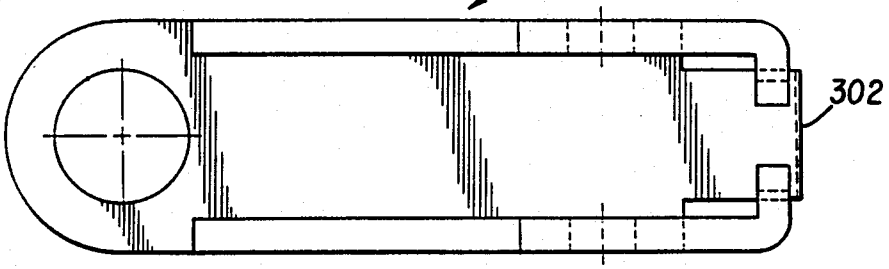
FIG. 8*b* is a top view of the contact bar in accordance wi a preferred embodiment of the present invention.
Figure 8C:
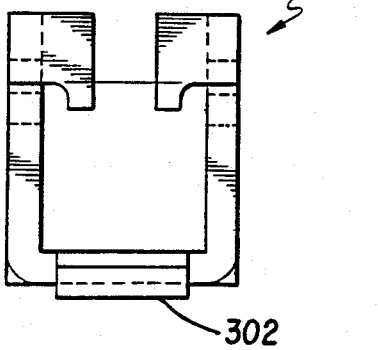
FIG. 8*c* is an end view of the contact bar in accordance with a preferred embodiment of the present invention.
Figure 7A:
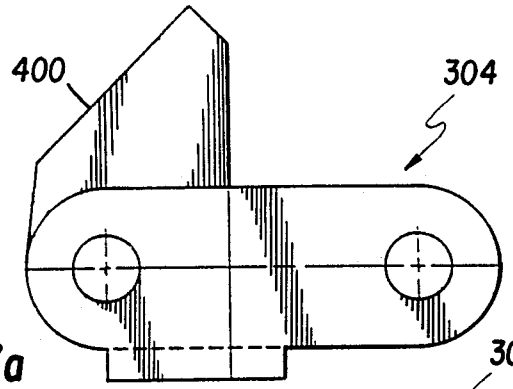
FIG. 7*a* is a side view of the contact bar carrier in accordance with a preferred embodiment of the present invention.
Figure 7B:
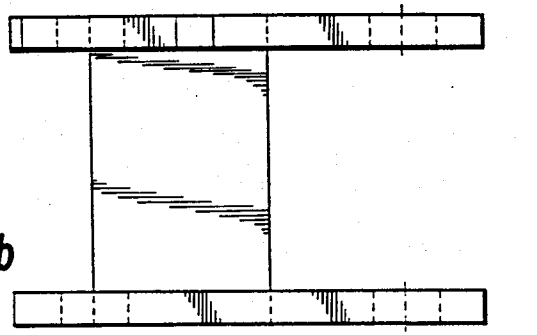
FIG. 7*b* is a top view of the contact bar carrier in accordance with a preferred embodiment of the present invention.
Figure 7C:
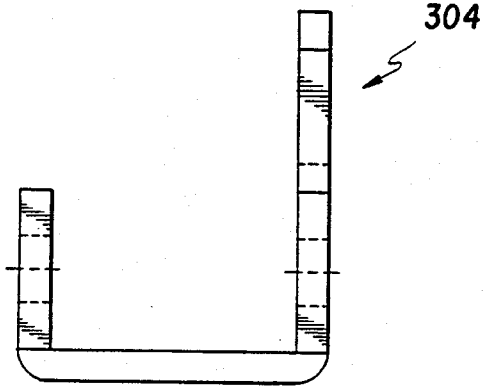
FIG. 7*c* is an end view of the contact bar carrier in accordance with a preferred embodiment of the present invention.

The sample embodiment of FIG. 3 has many features in common with the breaker shown in FIG. 1. To help make these similarities apparent, similar features have generally been given the same reference numbers. However, note that the breaker shown in FIG. 3 differs from that of FIG. 1 in significant ways. Notably, the embodiment of FIG. 3 has the combination of elements 300 and 304, instead of the element 80 of FIG. 1; and the embodiment of FIG. 1 has an elongated slot 85 surrounding pin 83, which the embodiment of FIG. 3 does not. For clarity in understanding these differences, FIGS. 7*a*, 7*b*, and 7*c* show three views of the presently preferred embodiment of contact bar carrier 304. FIGS. 8*a*, 8*b*, and 8*c* show three views of the presently preferred embodiment of contact bar 300.

In the sample embodiment of FIG. 3, the contact bar 300 includes a contact 82 and a pivot restriction flange 302. The contact bar 300 is pivotally connected by joint 78′ to the housing link 72 and contact bar carrier 304. The contact bar carrier 304 is pivotally the contact bar carrier 304 is a pivot restriction plate 306. In the position shown (where the handle in the ON position, and overcurrent tripping has not occurred) gap G2 is located between pivot restriction flange 302 and pivot restriction plate 306.

A spring 308 creates a clockwise bias (relative to the representation in FIG. 3) of the contact bar 300 about the joint 78′, as shown by arrow B. The clockwise travel (relative to the representation in FIG. 3) of the contact bar 300 about joint 78′ is restricted (in the position shown) by the contacts 82 and 84. Since point 78′ is not fixed, and contact bar carrier 304 can pivot around pin 83, the force applied by the spring 308 to the contact bar 300 also biases the contact bar carrier 304 in a counter-clockwise fashion (relative to the representation in FIG. 3) about pin 83′, as shown by arrow C. The counter-clockwise travel (relative to the representation in FIG. 3) of the contact bar carrier 304 is restricted by the downward force applied by the housing link 72 at the joint 78′.

Figure 4:
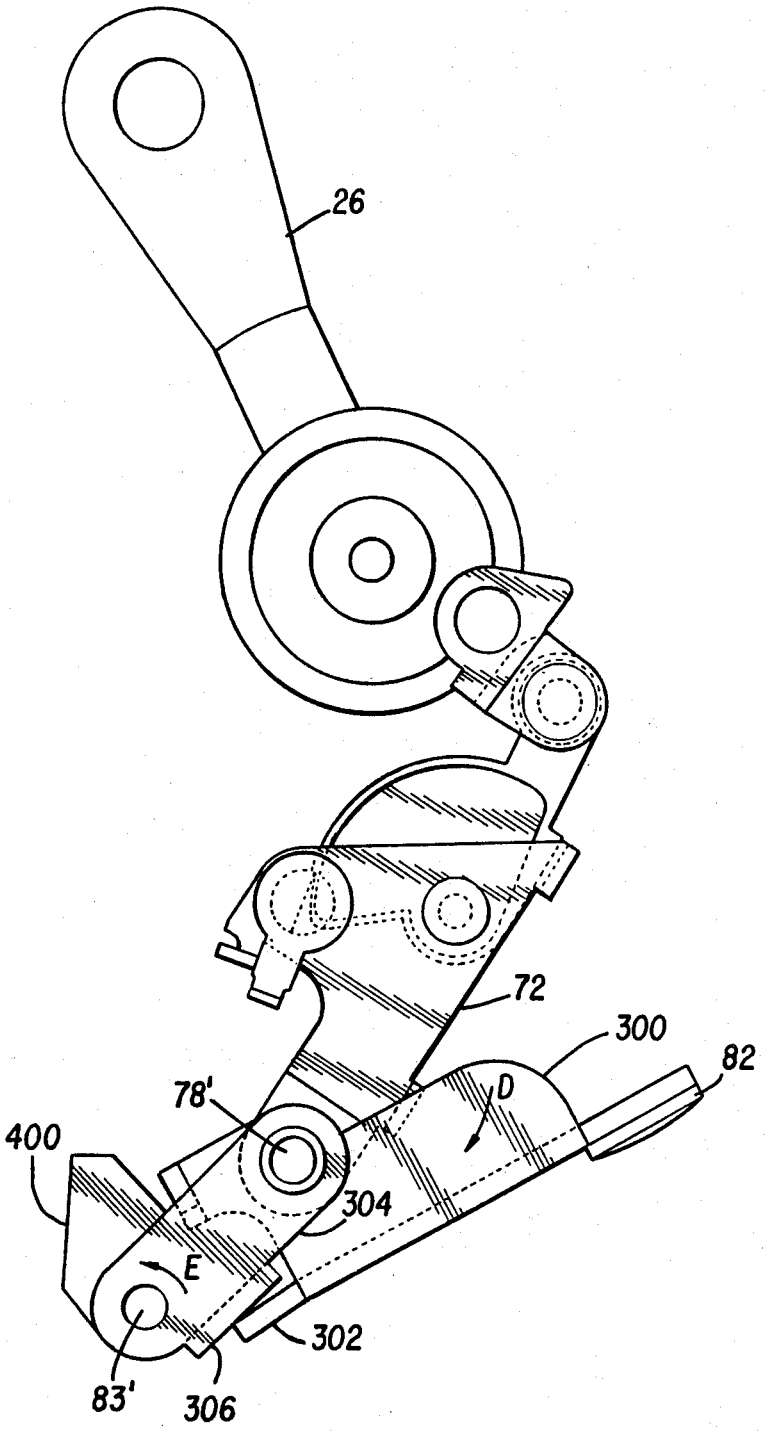

FIG. 4 shows an assembly like that of FIG. 3, in the position which would result from being manually turned OFF. The downward force of the housing link 72 has been removed from the joint 78′ by the counterclockwise rotation (relative to the representation in FIG. 4) of handle 26. The resulting vertical motion of joint 78′ has allowed several interactions of the various elements to occur.

First, as the joint 78′ begins to rise, the force of the spring 308 causes the contact bar 300 to rotate about joint 78′, as shown by arrow D. Thus, the vertical motion of joint 78′ will not initially produce vertical motion of contact 82, but will be counteracted by rotation at joint 78, so that the contacts 82 and 84 will remain in contact for a certain time after joint 78′ has already begun to rise. This extended contact time occurs in breakers like that of FIG. 3, but not in breakers like that of FIG. 1, even if all dimensions are otherwise the same. Thus, the additional articulation at joint 78′ (which the neutral breaker has, and the non-neutral breakers do not have) advantageously provides sequential operation in a multipole system.

This extended contact time comes to an end after pivot restriction flange 302 encounters pivot restriction plate 306. Once the gap G2 (between 302 and 306) is closed, the further upward movement of joint 78′ and the further rotation of the contact bar carrier 304 (as shown by arrow E) cause the contact bar 300, and its associated contact 82, to move upward to a position as shown in FIG. 4. This movement thereby breaks electrical contact. The rotation of the contact bar carrier 304 is restricted when the flange 400 of the contact bar carrier contacts the frame 34 (not shown in FIG. 4).

Figure 5A:
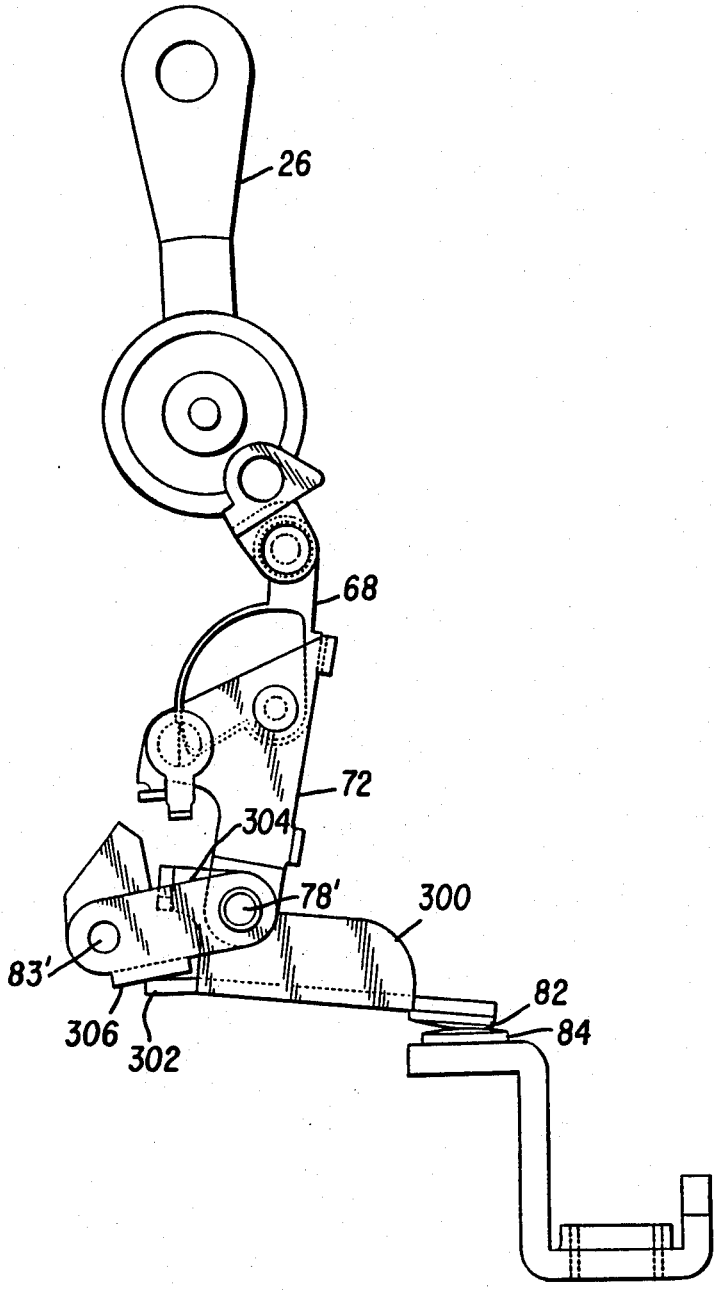
Figure 6A:
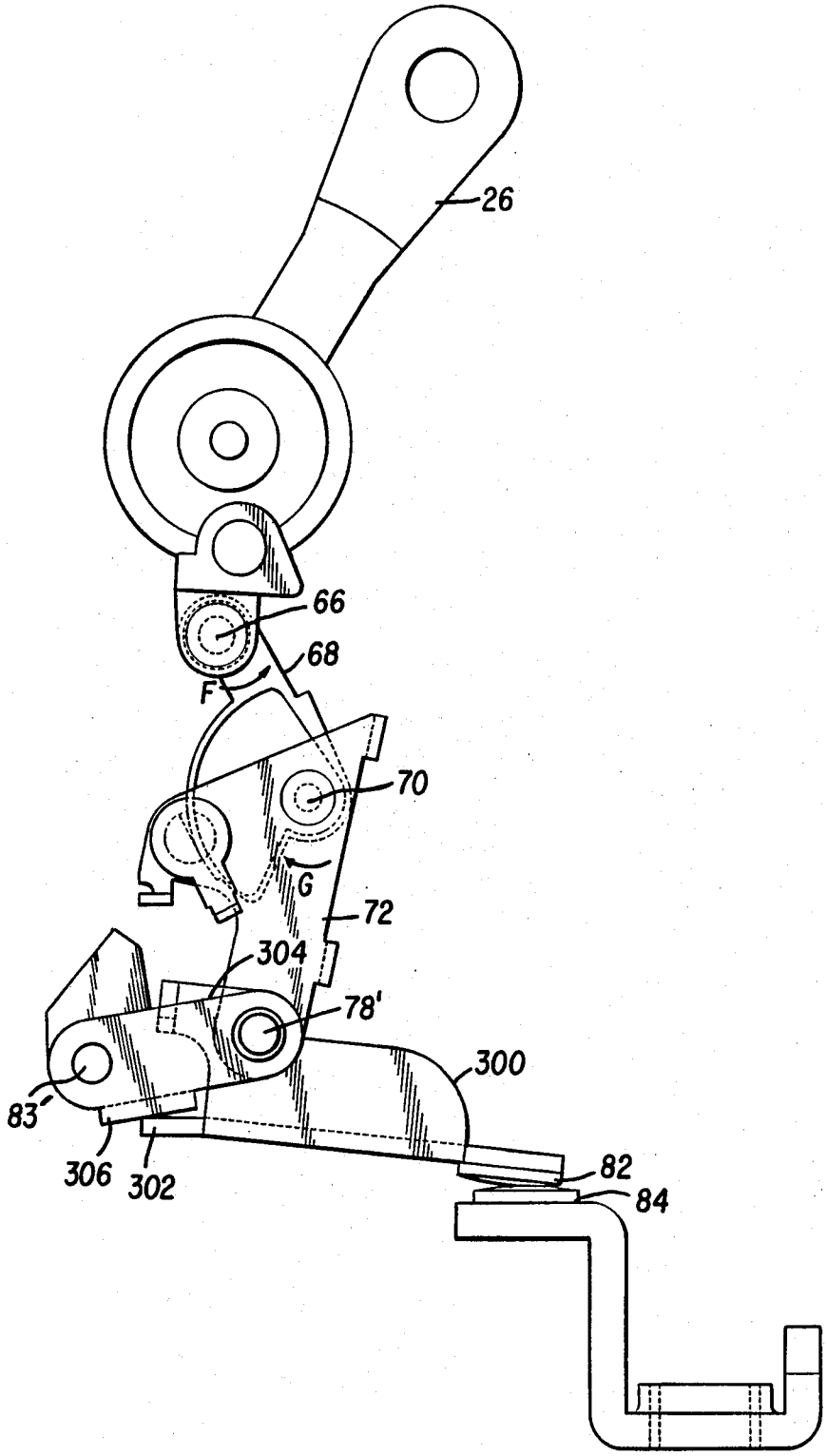

It can be seen that a similar (but reversed) sequence of movements of the cooperating elements will occur during manual closing of the breaker. As the joint 78′ is forced downward by the housing link 72, the gap between the contacts 82 and 84 will close. FIG. 5*a* shows the neutral breaker mechanism in the intermediate position where the contacts 82 and 84 have just formed an electrical connection. Notice that the gap G2 between the pivot restriction plate 306 and the pivot restriction flange 302 has not yet opened up. FIG. 6*a* similarly shows the relationship between the elements (including contacts 82 and 84, the contact bar 300, the contact bar carrier 304, the pivot restriction flange 302, and the pivot restriction plate 306) of a breaker like that shown in FIG. 3, at a moment when the contacts 82 and 84 are just about to separate during a trip condition, where sear pin 74 has rotated to release the cam link 68, resulting in movements G (of housing link 72) and F (of cam link 68).

Figure 5B:
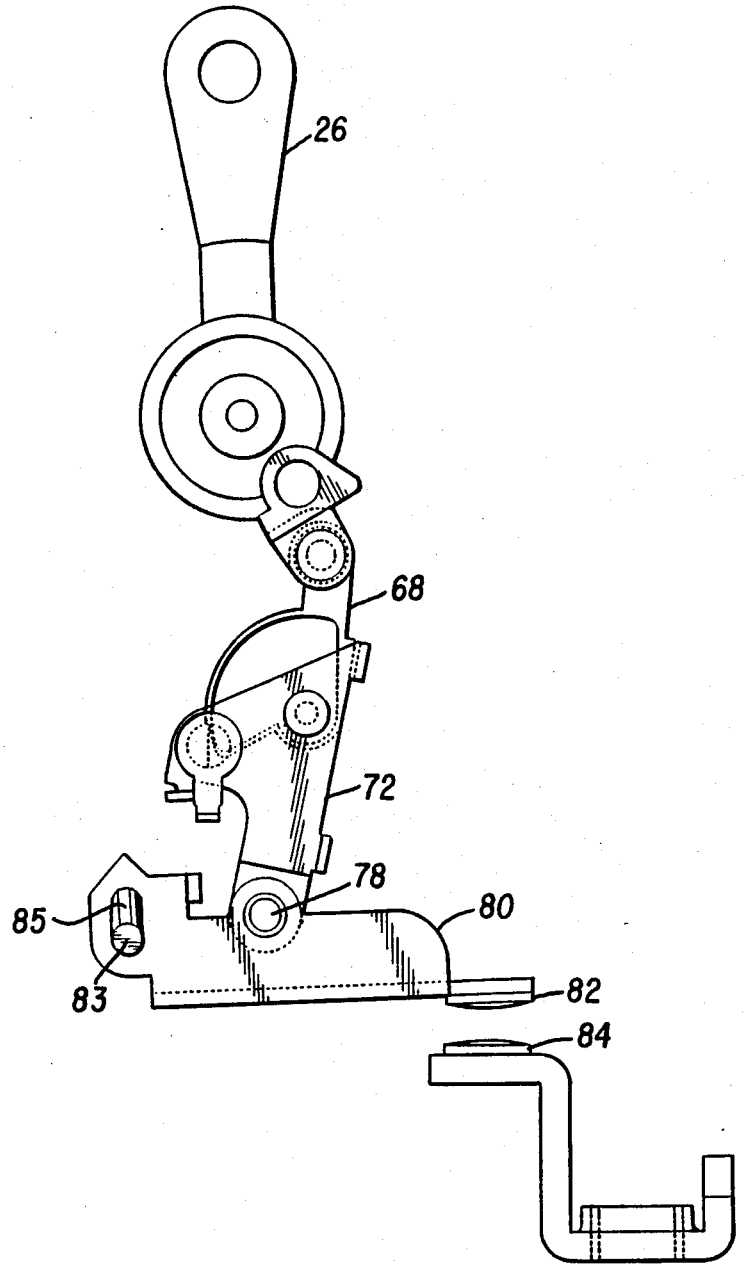

A comparison of FIGS. 5*a* and 5*b* illustrates the sequential contact operation provided by the differences between the neutral and non-neutral circuit breakers during the manual operation of the system. It can be seen that the handle 26, the cam link 68, and the housing link 72 in FIG. 5*a* are in the same relative position as the corresponding elements in FIG. 5*b*. This spatial relationship between the neutral and nonneutral breaker assemblies is caused by the linkage which connects the handles of the single pole breaker assemblies. (Alternatively, of course, it would be possible to use only one handle for all the breakers of a multipole breaker system.)

Therefore, in a multipole circuit breaker system which comprises single pole breaker assemblies such as shown in FIGS. 5*a* and 5*b*, it can be seen that the neutral breaker assembly (as in FIG. 5*a*) will make electrical contact before the non-neutral breaker assembly (as shown in FIG. 5*b*) during a manual closing of the system. Also, it can be seen that the neutral breaker assembly (as in FIG. 5*a*) will break electrical contact after the non-neutral breaker assembly (as shown in FIG. 5*b*) during a manual opening of the system.

Figure 6B:
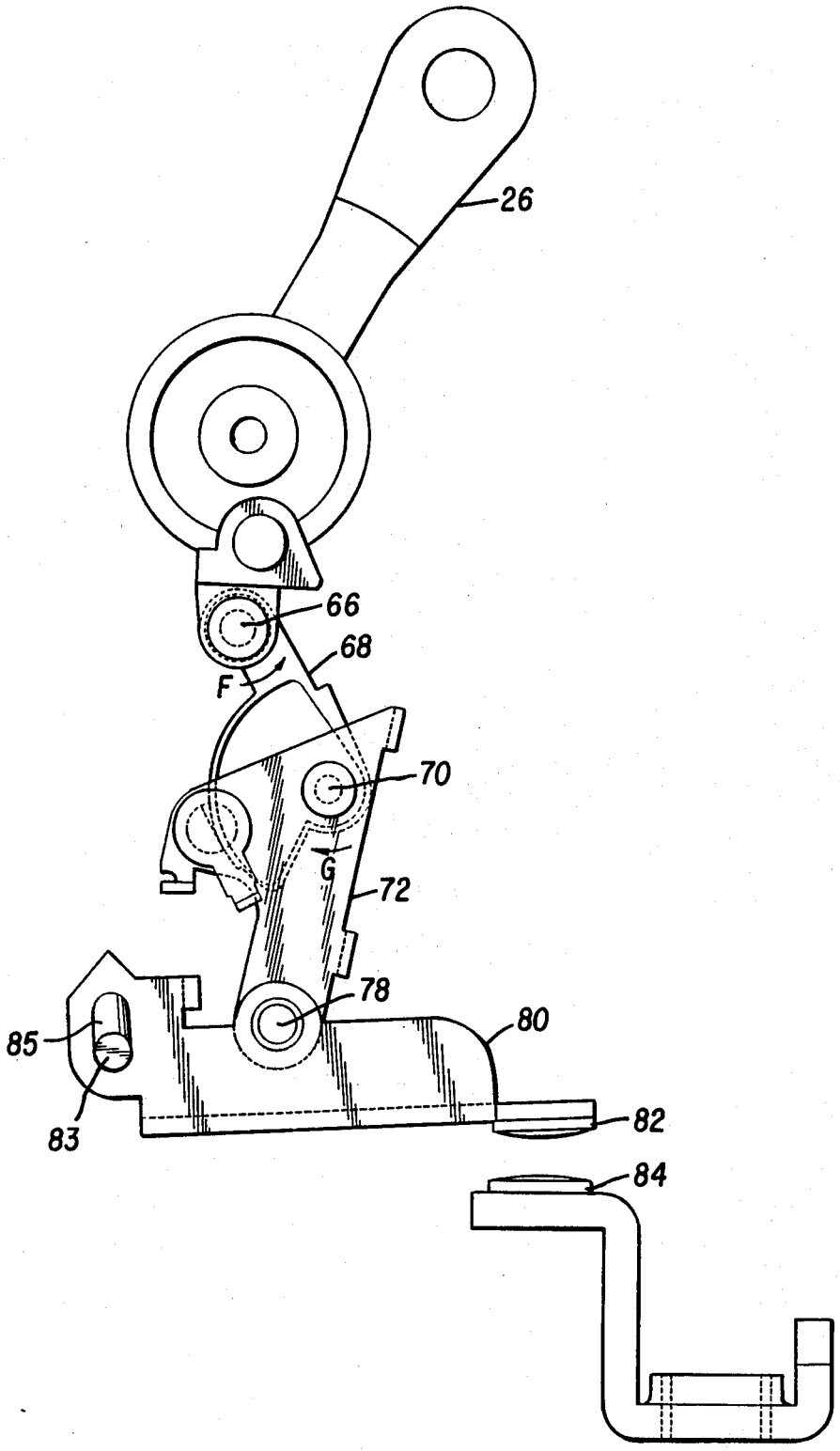

Similarly, comparison of FIGS. 6*a* and 6*b* illustrates the sequential contact operation provided by the differences between the neutral and non-neutral circuit breakers during the trip operation of the system. These figures illustrate the breaker assemblies in an intermediate position, during corresponding moments of a trip condition.

The handles 26 are both rotated fully clockwise and in the ON position. The cam links 68 have both pivoted about pin 66 in a counterclockwise fashion, as shown by arrow F. The housing links 72 have both rotated in a clockwise fashion about pin 70, as shown by arrow G. It can be seen that the handle 26, the cam link 68, and the housing link 72 of FIG. 6*a* are in the same relative positions as those shown in FIG. 6*b*. Therefore, in the multipole circuit breaker system of the present invention which comprises the assemblies as shown in FIGS. 6*a* and 6*b*, it can be seen that the non-neutral breaker (as shown in FIG. 6*b*) will break contact before the neutral breaker (as shown in FIG. 6*a*).

In another of its aspects, the present invention provides a neutral breaker wherein the overtravel of the mechanism occurs at a different pivot point than that of the non-neutral breaker. The overtravel of a circuit breaker mechanism generally relates to motion of the various component elements while the contacts 82 and 84 are in electrical connection. The overtravel may be utilized to further bias various spring elements and thereby ensures a sufficient force is applied to the contacts 82 and 84 to cause them to remain in electrical connection.

In the present invention, the overtravel of the non-neutral breaker occurs at pin 83. The non-neutral breaker is shown in FIGS. 2, 5*b*, and 6*b*, in various positions with the contacts not in electrical connection. Pin 83 is located at the lower end of slot 85 on contact arm 80.

Referring now to FIG. 1, pin 83 is located upwardly in its slot on contact arm 80 against the bias of spring 81. The sliding of pin 83 in its slot is caused by the further downward movement of the mechanism after the contacts 82 and 84 have formed an electrical connection.

The overtravel of the neutral breaker occurs at joint 78. Notice there is no slot for pin 83 to slide in, in the embodiments shown in FIGS. 3, 4, 5*a*, and 6*a*. In a closing operation, the further downward movement of the mechanism after the contacts 82 and 84 have formed an electrical connection causes the gap G2 to open against the bias of spring 308. Similar interactions (in an opposite sequence) will occur during the opening operation of the breakers.

The mechanism which is used, in the presently preferred embodiment, to link the tripping operations of the several breakers in a multipole circuit breaker will now be described. (Of course, various other mechanisms could be used instead, as is well known to those skilled in the art.)

Figure 9A:
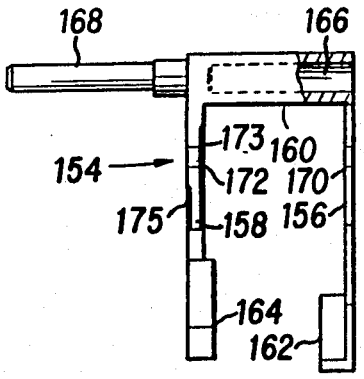
FIGS. 9*a* and 9*b* show end and side views, respectively, of a trip lever used in the presently preferred embodiment to link the trip mechanisms in a multipole breaker.
Figure 9B:
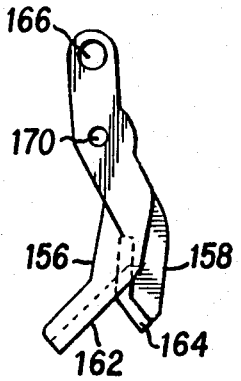
Figure 10:
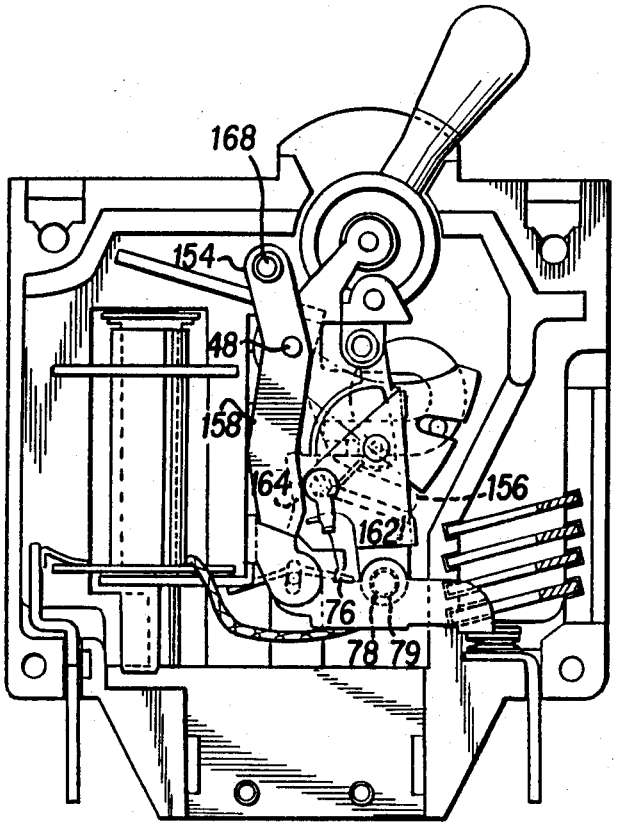
FIG. 10 shows how a trip lever shown in FIGS. 9*a* and 9*b* interacts with a mechanism like that of FIG. 1 or FIG. 3.

FIGS. 9*a* and 9*b* show end and side views, respectively, of a trip lever 154 used in the presently preferred embodiment to link the several trip mechanisms in a multipole breaker, and FIG. 10 shows how such a trip lever interacts with a mechanism like that of FIG. 1 or FIG. 3. The trip lever 154 preferably includes a first leg 156 and a second leg 158. A connecting member 160 joins legs 156 and 158 at one end of each leg. A flange 162 at the other end of the first leg 156 is adapted to be engaged by enlarged rivet end 79 at joint 78. A flange 164 on the other end of second leg 158 is adapted to strike sear striker bar 76. Connecting portion 160 includes a tapered aperture 166 therein, shown partly in section in FIG. 9*a*. The internal diameter of aperture 166 decreases toward its innermost portion. A complementary tapered extension 168 extends from connecting portion 160. The diameter of extension 168 decreases toward its outer endmost portion. Aperture 166 and extension 168 have similar tapers, whereby an extension 168 of one trip lever may be easily inserted yet snugly seated within an aperture 166 on a similar adjacent trip lever for frictional engagement with the adjacent trip lever. Legs 156 and 158 include a pair of aligned apertures 170 and 172, respectively, for pivotally mounting lever 154 on pin 48 in frame 34, as illustrated in FIG. 10. A pair of recesses 173 and 175 in leg 158 accommodates a spring (not shown) which biases lever 154 in a clockwise direction as viewed in FIG. 10. The circuit breaker casing includes an opening (not shown) which permits an extension 168 of one breaker pole to project out from the pole casing and to extend into the housing of an adjacent breaker pole. Extension 168 of the last pole is simply cut off so as not to protrude from the device.

When so arranged, trip levers 154 of adjacent poles mate with each other by means of extensions 168 and apertures 166. When properly joined together, the outer surface of one tapered extension 168 mates snugly and securely with the similarly tapered inner surface of an adjacent aperture 166. If any pole of the multipole circuit breaker of the presently preferred embodiment is tripped open by an overcurrent, upward motion of contact arm 80 will cause enlarged end 79 of rivet 78 (FIG. 10) to strike flange 162 of leg 156. This will cause the trip lever of the tripped pole to pivot about pin 48 in a counterclockwise direction (as shown in FIG. 10). The several trip levers, joined by the improved mating means 166, 168 of the present invention, will rotate similarly and substantially simultaneously. Flange 164 of each trip lever will strike respective sear striker bars 76 of the other, still closed, breaker poles. This will trip open each pole of the multipole circuit breaker.

Figure 11A:
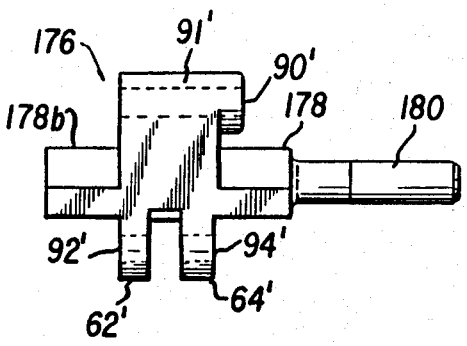
FIGS. 11*a* and 11*b* are side and end views, respectively, of a handle link used in the presently preferred embodiment to link the manual actuation mechanisms in a multipole breaker.
Figure 11B:
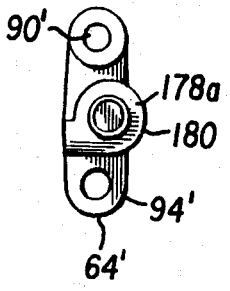

The mechanism which is used, in the presently preferred embodiment, to link the manual operation of the several breakers in a multipole circuit breaker will now be described. (Of course, various other mechanisms could be used instead, as is well known to those skilled in the art.) FIGS. 11*a* and 11*b* are side and end views, respectively, of a handle link used in the presently preferred embodiment to link the manual actuation mechanisms in a multipole breaker. In this embodiment, handle 26 is modified to include a pair of oppositely extending lateral protrusions 100 having apertures 102 contained therein. These apertures, like aperture 166 of trip lever 154, are tapered.

Handle link 176 is used in place of handle 26 in single handle multipole embodiments of the invention. Handle link 176 is operatively similar to handle 26, but does not include a portion, e.g., like handle portion 27, which extends outwardly of the casing to permit manual operation of the breaker pole with which handle link 176 is associated. Movement of handle link 176 results from movement of the handle 26 (of an associated pole) to which link 176 is joined.

A pair of lateral protrusions 178*a*, 178*b* extends from opposite sides of handle link 176. Protrusions 178*a*, 178*b* are spaced from opening 90' a radial distance which corresponds to the radial distance between centers of aperture 102 and opening 90 of handle 26. A tapered extension portion 180 extends from one lateral protrusion 178*a*. The casing of the presently preferred embodiment includes at least one arcuate opening 182 which permits extensions 180 to extend into the casings of adjacent poles.

When the poles of the multiple circuit breaker are arranged adjacent each other, an extension 180 of a breaker pole will seat snugly in a friction fit arrangement within aperture 102 of the pole containing handle 26. Thus, when handle 26 is pivoted about its axis, all handle links joined thereto will also pivot, whereby each pole will be substantially simultaneously opened or closed. The precise fit of extensions 180 within apertures 102, in like manner as described above with respect to apertures 166 and extensions 168, assures essentially simultaneous movement of all breakers.

In order to eliminate disadvantageous lag times in the manual activation of multipole breaker units, it may be necessary to limit the number of breaker poles that are joined in a multipole assembly. Although two breakers may be essentially simultaneously controlled by a single throw joining their respective handle mechanisms, even the use of handle link mechanisms of the present invention may not eliminate all delays in breaker activation when more than four-breaker multipole assemblies are used. Thus, for example, in a four-breaker multipole assembly of the present invention, the two central breaker poles are activated by externally connected toggle handles 26 and the two outside breakers are joined to the inner breakers via handle links 176 described above and their respective tapered portions 180. Note, the desirable simultaneous activation of the circuit breaker system should not be confused with the desirable features of sequential contact operation of the present invention.

Figure 12:
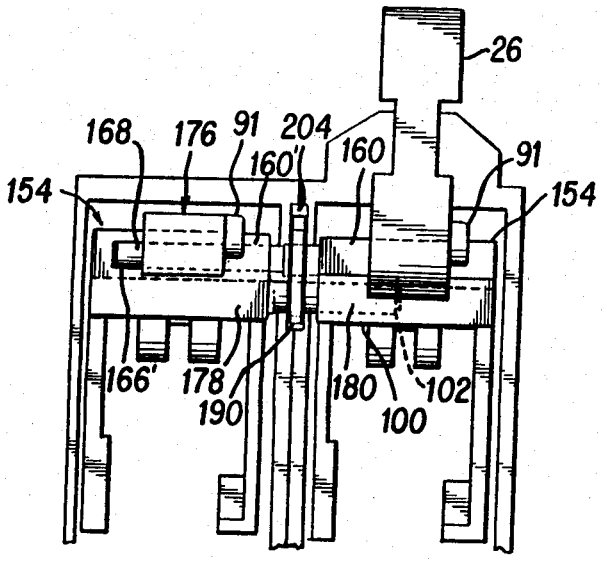
FIG. 12 shows the handle and trip lever mechanisms of a multipole circuit breaker like those of FIGS. 1 and 3, linked to trip or switch together breakers.

FIG. 12 illustrates adjacent poles of a multipole circuit breaker according to the presently preferred embodiment and the manner in which a handle, handle link, and trip levers thereof are joined.

The several single pole breakers of the multipole breaker system may be interconnected by any of several known methods. Due to the many similar parts and the interconnection of the neutral and non-neutral breakers of the present system, it may be seen that the various component parts of the individual breakers, such as the toggle links, may operate in a substantially simultaneous fashion during a manual activation or a trip condition. The substantially simultaneous operation of various parts of the neutral and non-neutral breakers of the system is important in causing the previously described desired sequential contact operation.

While the presently preferred embodiment, in its various aspects, has been described with reference to the accompanying figures, it should be understood that the invention is not limited to the details shown in the figures, the invention being limited only by the claims appended hereto.

What is claimed is:

1. A multipole circuit breaker system comprising:

a handle movable to make or break contact;

a plurality of breaker assemblies of first and second types, each said breaker assembly comprising:

(a) movable contact means for electrically contacting a fixed contact means;

(b) a collapsible toggle, mechanically connected to said handle and to said movable contact means in such relation that collapse of said toggle permits said movable contact means to move away from said fixed contact means;

said assemblies of said second type, but not said assemblies of said first type, further comprising a contact bar means and a contact bar carrier means, wherein (1) said contact bar carrier means is pivotably mounted at a first connection; and (2) said contact bar means and said contact bar carrier means are pivotably connected together at a second connection, apart from said first connection such that overtravel in response to movement of said handle to make contact occur at said second connection.

2. The system of claim 1, further comprising a handle means for manually operating said circuit breaker assemblies.

3. The system of claim 1, further comprising a plurality of handle means for manually operating said plurality of circuit breaker assemblies.

4. The system of claim further comprising a plurality of handle means for manually operating said plurality of circuit breaker assemblies, wherein said plurality of handle means are connected so as to cause said plurality of handle means to move substantially in unison.

5. The system of claim 1, wherein said handles are connected together with at least one pin.

6. The system of claim 1, wherein said assemblies comprise respective toggle means connected together in such mechanical relation that collapsing of one of said toggles will tend to cause others of said toggles to collapse.

7. The system of claim 1, wherein said assemblies comprise respective toggle means connected together by at least one pin.

8. The system of claim 1, wherein said assemblies have respective spring-loadings such that, when urged by said handle, a first one of said assemblies makes contact prior to a second one of said assemblies, and such that, when said toggle collapses, said second of said assemblies breaks contact prior to said first of said assemblies.

9. The system of claim 1, wherein said assemblies have respective spring-loadings such that, when urged by said handle, a first one of said assemblies makes contact prior to a second one of said assemblies, and such that, when said toggle collapses, said second of said assemblies breaks contact prior to said first of said assemblies;

and wherein said first of said assemblies is connected to a neutral leg of a power supply system.

10. The system of claim 1, wherein said assemblies have respective spring-loadings such that, when urged by said handle, a first one of said assemblies makes contact prior to a second one of said assemblies, and such that, when said toggle collapses, said second of said assemblies breaks contact prior to said first of said assemblies;

and wherein said second of said assemblies is connected to an electrified hot leg of a power supply system.

11. The system of claim 1, wherein each said breaker assembly comprises a trip condition detector, and said respective toggle means is mechanically connected to said trip condition detector in such relation that motion of said trip condition detector can collapse said toggle.

12. The system of claim 1, wherein each said breaker assembly comprises a solenoid connected to collapse said toggle when an overcurrent condition occurs.

13. The system of claim 1, wherein said breaker assemblies of said second type further comprise a joint for producing an articulation in the movement of said movable contact means, such that said movable contact means an said fixed contact means of said assemblies of said second type break contact after said movable contact means and said fixed contact means of said assemblies of said first type break contact.

14. The system of claim 13, wherein the effective spring constant, at said movable contact means and said fixed contact means, is smaller at the point of travel where said contacts of said assemblies of said second type first make contact, then the effective spring constant at the point of travel where said contacts of said assemblies said first type first make contact.

* * * * *